US006461779B1

(12) United States Patent
Watanabe et al.

(10) Patent No.: US 6,461,779 B1
(45) Date of Patent: Oct. 8, 2002

(54) SINGLE-LAYER TYPE ELECTROPHOTOSENSITIVE MATERIAL

(75) Inventors: Yukimasa Watanabe, Osaka (JP); Jun Azuma, Osaka (JP); Kyoichi Nakamura, Osaka (JP); Ayako Yashima, Osaka (JP); Hisakazu Honma, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 30 days.

(21) Appl. No.: 09/819,683

(22) Filed: Mar. 29, 2001

(30) Foreign Application Priority Data

Nov. 14, 2000 (JP) ..... 2000-346709
Nov. 30, 2000 (JP) ..... 2000-364683

(51) Int. Cl.[7] ..... G03G 15/00
(52) U.S. Cl. ..... 430/56
(58) Field of Search ..... 430/56

(56) References Cited

U.S. PATENT DOCUMENTS 5,319,069 A 6/1994 Sasaki et al.
5,670,284 A * 9/1997 Kishi et al. ..... 430/57.1

FOREIGN PATENT DOCUMENTS

| | | |
|---|---|---|
| EP | 0 863 442 A2 | 9/1998 |
| EP | 1 054 298 A1 | 11/2000 |
| JP | 5-333577 | 12/1993 |
| JP | 5-333578 | 12/1993 |
| JP | 5-333579 | 12/1993 |
| JP | 5-346-674 | 12/1993 |
| JP | 2000-075520 | 3/2000 |
| JP | 2000-147806 | 5/2000 |
| JP | 2000-242009 | 9/2000 |
| JP | 2000-258936 | 9/2000 |

OTHER PUBLICATIONS

Patent Abstracts of Japan, vol. 015, No. 451, Nov. 15, 1991.
Patent Abstracts of Japan, vol. 012, No. 497, Dec. 26, 1988.

* cited by examiner

*Primary Examiner*—Mark Chapman
(74) *Attorney, Agent, or Firm*—Smith, Gambrell & Russell LLP

(57) ABSTRACT

Disclosed is a single-layer type electrophotosensitive material which comprises a conductive substrate, and a photosensitive layer made of a binder resin containing at least an electric charge generating material and an electric charge transferring material formed on said conductive substrate, wherein said photosensitive layer contains a polyalkylene glycol compound represented by the formula [1]:

$$A_1—O—[(CH_2)_m—O]_n—A_2$$

wherein $A_1$ and $A_2$ are the same or different and represent an alkyl or aryl group having 1 to 50 carbon atoms, or a group: —CO—$R^{10}$ ($R^{10}$ represents an alkyl or aryl group having 1 to 50 carbon atoms), m represents an integer of 1 to 5, and n represents an integer of 2 to 100, which is superior in wear resistance, sensitivity and gas resistance.

10 Claims, 3 Drawing Sheets

SINGLE-LAYER TYPE ELECTROPHOTOSENSITIVE MATERIAL

BACKGROUND OF THE INVENTION

The present invention relates to a single-layer type electrophotosensitive material, which is used in image forming apparatuses such as electrostatic copying machine, facsimile and laser beam printer. More particularly, the present invention relates to a single-layer type electrophotosensitive material, which is superior in wear resistance and has a long life.

In the image forming apparatuses described above, various photosensitive materials having the sensitivity within a wavelength range of a light source used in said apparatuses have been used. One of them is an inorganic photosensitive material using an inorganic material such as selenium in a photosensitive layer, while the other one is an organic photosensitive material (OPC) using an organic material in a photosensitive layer. Among these photosensitive materials, the organic photosensitive material has widely been studied because it is easily produced as compared with the inorganic photosensitive material and has a wide range of choice of photosensitive materials such as electric charge transferring material, electric charge generating material and binder resin as well as high functional design freedom.

The organic photosensitive materials are classified roughly into a so-called multi-layer type electrophotosensitive material (hereinafter abbreviated to a "multi-layer type photosensitive material", sometimes) having a structure of an electric charge generating layer containing an electric charge generating material and an electric charge transferring layer containing an electric charge transferring material, which are mutually laminated, and a single-layer type photosensitive material (hereinafter abbreviated to a "single-layer type photosensitive material", sometimes) wherein an electric charge generating material and an electric charge transferring material are dispersed in the same photosensitive layer. Among these organic photosensitive materials, it is a multi-layer type photosensitive material, which has a monopoly position in the wide market. The multi-layer type photosensitive material is exclusively a negative charging type photosensitive material comprising a conductive substrate, and an electric charge generating layer and an electric charge transferring layer formed in order on the conductive substrate.

On the other hand, the single-layer type photosensitive material has become of major interest recently because of its advantages described below. That is, the single-layer type photosensitive material is superior in productivity because of its simple layer construction and can inhibit the occurrence of layer defects of the photosensitive layer, and can also improve optical characteristics because of less interface between layers. Furthermore, one photosensitive material can be used as both of positive and negative charge type photosensitive materials by using, as the electric charge transferring material, an electron transferring material and a hole transferring material in combination.

The electrophotosensitive material is used in the repeated steps of charging, exposing, developing, transferring, cleaning and charge neutralizing in the image formation process. An electrostatic latent image formed by charging/exposure is developed with a toner as a powder in the form of microparticles. Furthermore, the developed toner is transferred to a transfer material such as paper in the transfer process. However, the toner is not transferred completely (100%) and is partially remained on the photosensitive material. If the remained toner is not removed, it is made impossible to obtain a high-quality image, which is free from contamination in the repeated processes. Therefore, it is required to clean the remained toner.

In the cleaning process, a fur brush, a magnetic brush or a blade is typically used. In view of the cleaning accuracy and rationalization of apparatus construction, it is general to select a blade cleaning wherein cleaning is performed by contacting a blade-shaped resin plate directly with a photosensitive material.

Although the blade cleaning has high accuracy, it increases a mechanical load on the photosensitive material, thereby causing problems such as increase in wear amount of the photosensitive layer, reduction in surface potential, lowering of the sensitivity and the like, thus making it difficult to obtain a high-quality image.

Unlike the multi-layer type photosensitive material, in case of the single-layer type electrophotosensitive material, the electric charge generating layer also exists on the outermost surface of the photosensitive layer as far as an overcoat layer is not formed. To the contrary, the electric charge generating layer is protected with the electric charge transferring layer in case of the negative charging multi-layer type photosensitive material. In case of the single-layer type photosensitive material, the electric charge generating material is often exposed to active gases such as ozone and NOx evolved in the image forming apparatus. Therefore, the charging capability of the photosensitive material is lowered and defects such as image fogging are likely to be caused by a reduction in surface potential.

In case of designing a so-called "long-life" photosensitive material wherein image defects such as fogging do not occur even when printed a lot, there is disclosed a technique of using a resin having improved wear resistance, or various lubricants made of ester derivatives of stearic and lauric acids, fluororesin and the like. According to the technique described above, the wear resistance of the photosensitive layer is improved. However, it becomes difficult to scrape off the surface portion of the photosensitive layer, the charging capability of which is lowered by exposing to active gases such as ozone and NOx evolved in the image forming apparatus, thus making it impossible to obtain a "long-life"photosensitive material.

Japanese Published Unexamined Patent Application (Kokai Tokkyo Koho Hei) Nos. 5-333577, 5-333578, 5-333579 and 5-346674 disclose that a multi-layer type photosensitive material containing a specific electric charge generating material and polyethylene glycol having a molecular weight of 2000 or less in an electric charge generating layer is superior in charge stability. Since polyethylene glycol can also serve as a lubricant, it is expected that both of the wear resistance and the resistance to gases such as ozone and NOx are improved simultaneously when polyethylene glycol is applied to the single-layer type photosensitive material.

However, when polyethylene glycol is applied to the single-layer type photosensitive material, the sensitivity is drastically lowered. Therefore, it has been found that the resulting photosensitive material is not suited for practical use.

SUMMARY OF THE INVENTION

An object of the present invention is to provide a long-life single-layer type electrophotosensitive material, which is remarkably superior in wear resistance and sensitivity and is also superior in resistance to gases such as ozone and NOx.

In order to solve the problems described above, the present inventors have studied intensively and found a new fact that a long-life single-layer type electrophotosensitive material, which is remarkably superior in sensitivity and wear resistance and is also superior in resistance to gases such as ozone and NOx, can be obtained when incorporating a polyalkylene glycol compound whose terminal group is esterified or etherified, represented by the general formula [1]:

$A_1—O—[(CH_2)_m—O]_n—A_2$ wherein $A_1$ and $A_2$ are the same or different and represent an alkyl or aryl group having 1 to 50 carbon atoms, or a group: —CO—$R^{10}$ ($R^{10}$ represents an alkyl or aryl group having 1 to 50 carbon atoms), m represents an integer of 1 to 5, and n represents an integer of 2 to 100, into a photosensitive layer. Thus, the present invention has been completed.

That is, the single-layer type electrophotosensitive material of the present invention comprises a conductive substrate, and a photosensitive layer made of a binder resin containing at least an electric charge generating material and an electric charge transferring material formed on said conductive substrate, said photosensitive layer containing a polyalkylene glycol compound whose terminal group is esterified or etherified, represented by the general formula [1].

According to the present invention, a pseudo-three-dimensional network is formed by a bonding a hydrophilic functional group (e.g. hydroxyl group, carbonyl group, etc.) in the binder resin with an ester or ether group in a polyalkylene glycol compound represented by the general formula [1] by means of a van der Waal's force, a hydrogen bond or a chemical bond, in addition to a mere role of the polyalkylene compound as a lubricant, and the film hardness of the binder resin, in its turn the entire photosensitive layer, thus making it possible to obtain a single-layer type electrophotosensitive material which is less likely to cause wear, that is, an electrophotosensitive material having excellent wear resistance.

Since the formation of the above net work reduces micropores on the surface of the photosensitive layer, gases such as ozone and NOx are less likely to penetrate into the photosensitive layer from the surface of the photosensitive layer, thereby improving the gas resistance.

DETAILED DESCRIPTION OF THE INVENTION

Figure 1:
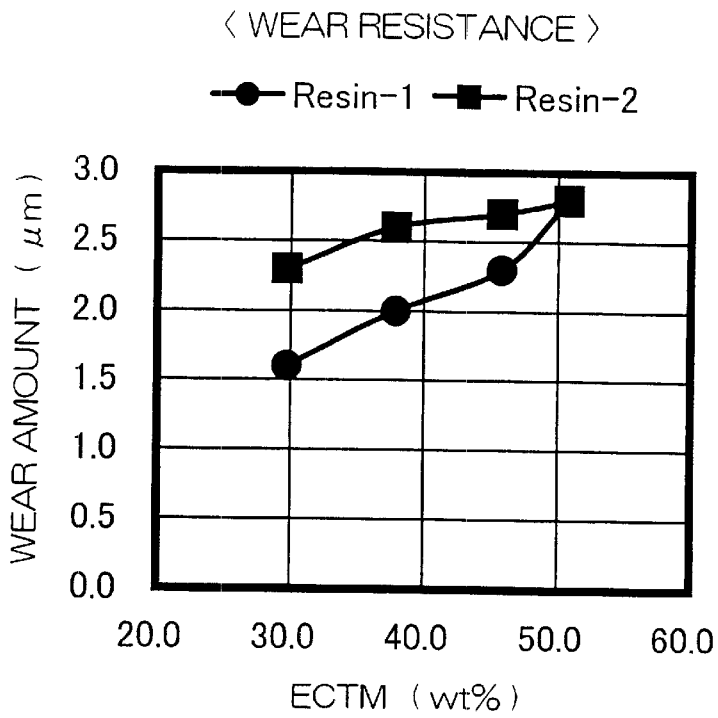
FIG. 1 is a graph showing the relationship between the solid content of an electric charge transferring materials relative to the entire solid content (ECTM) and the wear amount on the basis of evaluation date of Examples 1 to 4 and 26 to 29.

The single-layer type electrophotosensitive material of the present invention will be described in detail below.

The single-layer type electrophotosensitive material of the present invention comprises a conductive substrate, and a photosensitive layer made of a binder resin containing at least an electric charge generating material and an electric charge transferring material formed on said conductive substrate, said photosensitive layer containing a polyalkylene glycol compound whose terminal group is esterified or etherified, represented by the general formula [1].

<Polyalkylene Glycol Compound>

The polyalkylene compound used in the single-layer type electrophotosensitive material of the present invention is characterized in that a terminal hydroxyl group (—OH group) is esterified or etherified as represented by the general formula [1]. In case the terminal group is remained as the hydroxyl group without being esterified or etherified, that is, when using polyethylene glycol disclosed in Japanese Published Unexamined Patent Application (Kokai Tokkyo Koho Hei) Nos. 5-333577, 5-333578 and 5-346674, the sensitivity of the single-layer type electrophotosensitive material is drastically lowered.

The reason for lowering of the sensitivity are considered as follows. In case the hydroxyl group is remained without being treated, the compatibility of the polyalkylene glycol compound is lowered because of high hydrophilicity of the polyalkylene glycol compound in a binder resin having comparatively high hydrophobicity used in the photosensitive layer of the single-layer type photosensitive material such as polycarbonate resin. Therefore, agglomeration of the polyalkylene glycol compound molecules is liable to occur and the agglomerate of the compound molecules serves as a trap.

The polyalkylene glycol compound of the general formula [1] is preferably used, wherein carbon numbers of groups $A_1$ and $A_2$ are within a range from 1 to 25. In addition, in the general formula [1], the integer m is preferably 2 or 3, and the integer m is preferably 3 to 15 from viewpoint of gas resistance such as ozone and $NO_x$. As preferable embodiments, there are mentioned PEG-1 (e.g. IONET DL-200, produced by Sanyo Chemicals, Co., Ltd.), PEG-2 (e.g. IONET DS-300, produced by Sanyo Chemicals, Co., Ltd.), PEG-3 (e.g. product of Aldrich Co.), PEG-4 or PEG-5 chemical formulas of which are represented hereinafter.

The content of the polyalkylene glycol compound [1] is appropriately set according to the structure of the polyalkylene glycol compound and the structure of the binder resin and is not specifically limited, but is preferably not less than 50% by weight and not more than 500% by weight based on the content of the electric charge generating material.

The content of the electric charge generating material is preferably within a range from 0.1 to 20% by weight based on the total weight of the binder resin, as described below. Therefore, the content of the polyalkylene compound [1] is preferably within a range from 0.05 to 100% by weight, and more preferably from 1 to 15% by weight, based on the weight of the binder resin.

When the content of the polyalkylene glycol compound [1] exceeds 500% by weight based on the content of the electric charge generating material, the dispersibility and solubility of the electric charge generating material and electric charge transferring material contained in the binder resin are lowered, resulting in poor sensitivity. On the other hand, when the content of the polyalkylene glycol compound [1] is smaller than 50% by weight based on the content of the electric charge generating material, the number of bonds between an ester or ether group of the polyalkylene group and a hydrophilic functional group of the binder resin decreases. Therefore, it is not effective to improve the wear resistance and gas resistance.

<Binder Resin>

The binder resin used in the single-layer type electrophotosensitive material of the present invention, there can be used various resins which have conventionally used in the photosensitive material. For example, there can be used thermoplastic resins such as styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, vinyl chloride-vinyl acetate copolymer, polyester, alkyd resin, polyamide, polyurethane, polycarbonate, polyallylate, polysulfone, diallyl phthalate polymer, ketone resin, polyvinyl butyral, and polyether resin; crosslinkable thermosetting resins such as silicone resin, epoxy resin, phenol resin, urea resin, and melamine resin; and photocurable resins such as epoxy acrylate and urethane acrylate. These binder resins can be used alone, or two or more kinds of them can be copolymerized or blended.

Particularly, a binder resin containing a polycarbonate having a repeating unit represented by the general formula [2]:

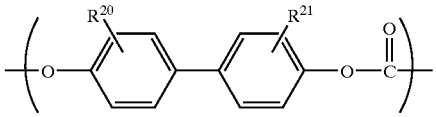

wherein $R^{20}$ and $R^{21}$ are the same or different and represent a hydrogen atom or an alkyl group having 1 to 3 carbon atoms, is preferably used.

The polycarbonate having a repeating unit represented by the general formula [2] is effective to improve the wear resistance because its molecular structure has high rigidity.

Furthermore, a copolymerized polycarbonate resin of a repeating unit represented by the general formula [2] and bisphenol Z is used most preferably.

The polycarbonate having a repeating unit represented by the general formula [2] is effective to improve the wear resistance, but is slightly inferior in compatibility with the polyalkylene compound represented by the general formula [1]. When the compatibility between the polyalkylene compound and the binder resin is poor, the sensitivity tends to be lowered, as described above.

On the other hand, a bisphenol Z type polycarbonate has good compatibility with the polyalkylene compound. Therefore, it becomes possible to simultaneously attain an improvement in wear resistance and an improvement in sensitivity by using the copolymerized polycarbonate resin of a repeating unit represented by the general formula [2] and bisphenol Z.

In the copolymerization, a molar ratio of the polycarbonate having a repeating unit represented by the general formula [2] to the bisphenol z type polycarbonate is preferably within a range from 5:95 to 50:50.

The binder resin described above preferably has a weight-average molecular weight within a range from 10,000 to 500,000, and more preferably from 30,000 to 200,000.

<Electric Charge Generating Material>

Examples of the electric charge generating material used in the single-layer type electrophotosensitive material of the present invention include conventionally known electric charge generating materials, for example, organic photoconductive materials such as metal-free phthalocyanine, oxotitanyl phthalocyanine, hydroxygalliumphthalocyanine, perylene pigment, bisazo pigment, dithioketopyrrolopyrrole pigment, metal-free naphthalocyanine pigment, metallic naphthalocyanine pigment, squaline pigment, trisazo pigment, indigo pigment, azulenium pigment, cyanine pigment, pyrylium salt pigment, anthanthrone pigment, triphenylmethane pigment, threne pigment, toluidine pigment, pyrrazoline pigment, and quinacridone pigment; and inorganic photoconductive materials such as selenium, selenium-tellurium, selenium-arsenic, cadmium sulfide, and amorphous silicon.

These electric charge generating materials can be uses alone or in combination so that the resulting electrophotosensitive material has an absorption wavelength within a desired range.

In digital optical image forming apparatuses (e.g. laser beam printer, facsimile, etc.) using a light source such as semiconductor laser, a photosensitive material having the sensitivity at a wavelength range of 700 nm or more is required. Therefore, phthalocyanine pigments such as metal-free phthalocyanine, oxotitanyl phthalocyanine and hydroxygallium phthalocyanine are preferably used among the electric charge generating materials described above. The crystal form of the above phthalocyanine pigment is not specifically limited and various phthalocyanine pigments can be used.

The content of the electric charge generating layer is preferably within a range from 0.1 to 20% by weight, and more preferably from 0.5 to 15% by weight, based on the total weight of the binder resin.

<Electric charge transferring material>

Examples of the electric charge transferring material used in the single-layer type electrophotosensitive material of the present invention include conventionally known electron transferring materials and hole transferring materials. In the single-layer type electrophotosensitive material, the photosensitive material contains a combination of the electron transferring material and the hole transferring material, particularly preferably.

<Hole transferring material>

Examples of the hole transferring material used in the single-layer type electrophotosensitive material of the present invention include nitrogen-containing compounds and condensed polycyclic compounds, for example, N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenantolylenediamine derivative, oxadiazole compound [e.g. 2,5-di(4-methylaminophenyl)-1,3,4-oxadiazole], styryl compound [e.g. 9-(4-diethylaminostyryl) anthracene], carbazole compound [e.g. poly-N-vinylcarbazole], organopolysilane compound, pyrazoline compound [e.g. 1-phenyl-3-(p-dimethylaminophenyl) pyrazoline], hydrazone compound, indole compound, oxazole compound, isoxazole compound, thiazole compound, thiadiazole compound, imidazole compound, pyrazole compound, and triazole compound.

It is particularly preferred that the electric charge transferring material contains one or more kinds selected from the group consisting of hole transferring materials represented by the general formulas [3], [4], [5] and [6].

Hole transferring material represented by the general formula [3]:

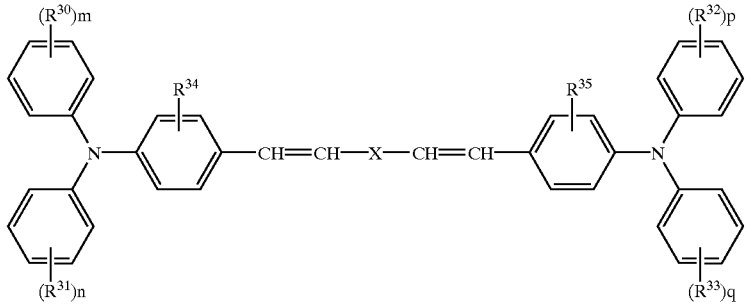

wherein $R^{30}$, $R^{31}$, $R^{32}$ and $R^{33}$ are the same or different and represent an alkyl group, an alkoxy group, an aryl group, an aralkyl group, or a halogen atom, m, n, p and q are the same or different and represent an integer of 0 to 3, $R^{34}$ and $R^{35}$ are the same or different and represent a hydrogen atom or an alkyl group, and —X— represents

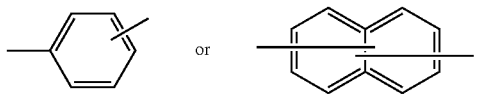

Hole transferring material represented by the general formula [4]:

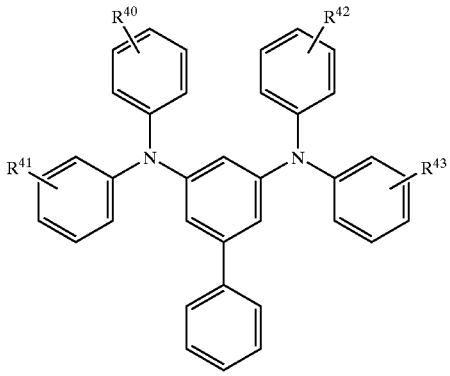

wherein $R^{40}$ and $R^{42}$ are the same or different and represent an alkyl group which may have a substituent, and $R^{41}$ and $R^{43}$ are the same or different and represent a hydrogen atom or an alkyl group which may have a substituent Hole transferring material represented by the general formula [5]:

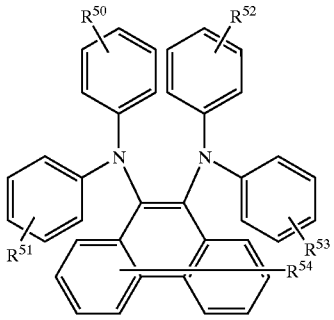

wherein $R^{50}$, $R^{51}$, $R^{52}$, $R^{53}$ and $R^{54}$ are the same or different and represent a hydrogen atom, a halogen atom, or an alkyl, or alkoxy group which may have a substituent, Hole transferring material represented by the general formula [6]:

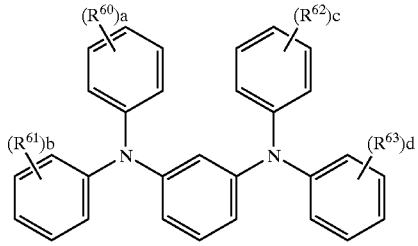

wherein $R^{60}$, $R^{61}$, $R^{62}$ and $R^{63}$ are the same or different and represent a halogen atom, or an alkyl, alkoxy or aryl group which may have a substituent, and a, b, c and d are the same or different and represent an integer of 0 to 5, provided that $R^{60}$, $R^{61}$, $R^{62}$ and $R^{63}$ may be different when a, b, c or d is not less than 2

The hole transferring material represented by the general formula [3], [4], [5] or [6] is effective to improve the sensitivity of the photosensitive material because it has very large mobility and is capable of efficiently transferring holes.

In the present invention, these hole transferring materials may be used alone, or two or more kinds of them may be used in combination.

<Electron Transferring Material>

As the electron transferring material, which can be used in the single-layer type electrophotosensitive material of the present invention, include various compounds having electron acceptability, for example, diphenoquinone derivative, benzoquionone derivative, azoquinone derivative described in Japanese Published Unexamined Patent Application (Kokai Tokkyo Koho) Nos. 2000-147806 and 2000-242009, monoquinone deribvative described in Japanese Published Unexamined Patent Application (Kokai Tokkyo Koho) Nos. 2000-075520 and 2000-258936, dinaphthylquinone derivative, dimide tetracarboxylate derivative, imide carboxylate derivative, stilbenequinone derivative, anthraquinone derivative, malononitrile derivative, thiopyran compound, trinitrothioxanthone derivative, 3,4,5,7-tetranitro-9-fluorenone derivative, dinitroanthracene derivative, dinitroacridine derivative, nitroanthraquinone derivative, dinitroanthraquinone derivative, tetracyanoethylene, 2,4,8-trinitrothoxanthone, dinitrobenzene, dinitroanthracene, dinitroacridine, nitroanthraquinone, dinitroanthraquinone, succinic anhydride, maleic anhydride, and dibromomaleic anhydride.

It is particularly preferred that the electric charge transferring material contains one or more kinds selected from the group consisting of hole transferring materials represented by the general formulas [7], [8], [9] and [10].

A compound represented by the general formula [7]:

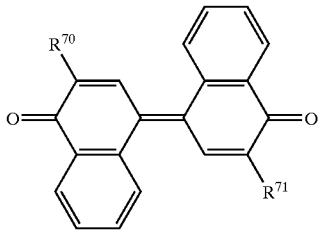

wherein $R^{70}$ and $R^{71}$ are the same or different and represent an alkyl group which may have a substituent.

A compound represented by the general formula [8]:

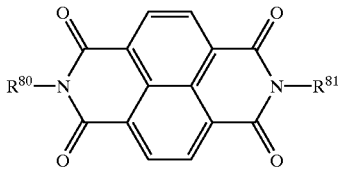

wherein $R^{80}$ and $R^{81}$ are the same or different and represent a monovalent hydrocarbon group which may have a substituent.

A compound represented by the general formula [9]:

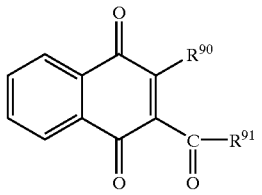

wherein $R^{90}$ represents a halogen atom, or an alkyl or aryl group which may have a substituent, and $R^{91}$ represents an alkyl or aryl group which may have a substituent, or a group: —O—$R^{91a}$ (in which $R^{91a}$ represents an alkyl or aryl group which may have a substituent).

A compound represented by the general formula [10]:

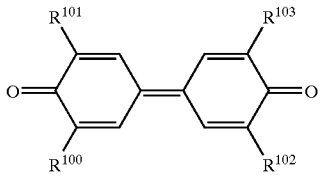

wherein $R^{100}$, $R^{101}$, $R^{102}$ and $R^{103}$ are the same or different and represent an alkyl group which may have a substituent.

In the present invention, these electron transferring materials may be used alone or in combination.

The solid content of the electric charge transferring material in the single-layer type electrophotosensitive material is preferably not less than 30% by weight and not more than 55% by weight, preferably not more than 50% by weight, based on the total solid content.

It has been known that the wear resistance of the photosensitive layer is lowered when the content of the electric charge transferring material increases. Therefore, the solid content is reduced ideally to improve the wear resistance. In case of the single-layer type photosensitive material, the photosensitive layer preferably contains both of the hole transferring material and the electron transferring material to improve the sensitivity, as described above. The solid content of the electric charge transferring material is sometimes larger than 50% by weight based on the total solid content.

However, a single-layer type photosensitive material, which has good sensitivity even in case of small solid content of not less than 30% by weight and not more than 50% by weight based on the total solid content, resulting in good wear resistance, can be obtained by using the hole transferring material represented by the general formula [3], [4], [5] or [6] or the electron transferring material represented by the general formula [7], [8], [9] or [10].

The thickness of the photosensitive layer of the single-layer type photosensitive material of the present invention is preferably within a range from 5 to 100 $\mu$m, and more preferably from 10 to 50 $\mu$m.

In addition to the respective components described above, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors can be incorporated as far as electrophotographic characteristics are not adversely affected. To improve the sensitivity of the photosensitive layer, for example, known sensitizers such as terphenyl, halonaphthoquinones and acenaphthylene may be used in combination with the electric charge generating material.

A barrier layer may be formed between the conductive substrate and the photosensitive layer as far as characteristics of the photosensitive material are not prevented.

As the substrate on which the photosensitive layer is formed, for example, various materials having the conductivity can be used. Examples thereof include metals such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The substrate may be in the form of a sheet or drum according to the structure of the image forming apparatus to be used. The substrate itself may have the conductivity, or the surface of the substrate may have the conductivity. The substrate may be preferably those having a sufficient mechanical strength.

When the photosensitive layer is formed by the coating method, a dispersion is prepared by dispersing and mixing the above electric charge generating material, electric charge transferring material and binder resin, together with a proper solvent, using a known method such as roll mill, ball mill, attritor, paint shaker, or ultrasonic dispersing equipment to prepare a dispersion, and then the resulting dispersion is coated by using a known means and dried.

As the solvent to prepare the above dispersion, various organic solvents can be used. Examples thereof include alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, and cyclohexanone; esters such as ethyl acetate and methyl acetate; and dimethylformaldehyde, dimethylformamide, and dimethyl sulfoxide.

To improve the dispersibility of the electric charge generating material and electric charge transferring material as well as the smoothness of the surface of the photosensitive layer, for example, surfactants and leveling agents may be added.

EXAMPLES

The following Examples and Comparative Examples further illustrate the present invention. The following embodiments are therefore to be considered as illustrative and the technical scope of the present invention is not limited by the embodiments.

Single-layer type electrophotosensitive materials produced by the following Examples and Comparative Examples were evaluated by the following methods.

<Evaluation Test of Wear Resistance>

Each of the electrophotosensitive materials in the respective Examples and Comparative Examples was mounted to a digital copy machine having a blade cleaning mean [Creage 7340, manufactured by Kyocera Mita Corporation]. A copying test was carried out by using A4-size papers of 250,000 pieces according to the above copying machine, and then the thickness of the photosensitive layer was measured. The wear amount was calculated as difference between two thicknesses of before and after copying. The smaller the difference, the better the wear resistance. The difference of 3 $\mu$m or more was rated "pass", while the difference exceeding 3 $\mu$m was rated "fail".

<Evaluation of Sensitivity>

Using a drum sensitivity tester manufactured by GENETEC Co., a voltage was applied on the surface of each of single-type electrophotosensitive materials of the respective Examples and Comparative Examples to charge the surface at +700V. Then, monochromic light having a wavelength of 780 nm (half-width: 20 nm, 1.0 $\mu J/cm^2$) from white light of a halogen lamp as an exposure light source of the above tester through a band-pass filter was irradiated on the surface of each of electrophotosensitive materials. A surface potential at the time at which 0.5 sec have passed since the beginning of exposure was as a residual potential $V_L$ (V) . The smaller the residual potential, the higher the sensitivity of the photosensitive material.

<Evaluation Test of Ozone Resistance >

Each surface potential of the electrophotosensitive materials in the respective Examples and Comparative Examples was measured by using a digital copy machine [Creage 7340, manufactured by Kyocera Mita Corporation], and then the above photosensitive material was exposed at ordinary temperature for 10 hours in dark atmosphere containing 10 ppm of ozone concentration. The surface potential was measured immediately after exposing.

$\Delta V_0$=(initial surface potential)−(Surface potential immediately after exposing)

The smaller $\Delta V_0$, the better the ozone resistance, and $\Delta V_0$ of less than 60V was rated "pass", $\Delta V_0$ of 60V or more was rated "fail".

Moreover, chemical formulas of the electron transferring materials, the hole transferring materials, binding resins and the polyalkylene glycol compounds used in the following Examples and Comparative Examples are listed hereinafter.

In the following Tables, abbreviations are used as below:

Ex.: Example, Co.Ex.: Comparative Example, PAGO: Polyalkylene glycol compound, HTM: Hole transferring material, ETM: Electron transferring material, ECTM: Solid content of electric charge transferring materials based on the entire solid content,

Examples 1 to 23

3.5 parts by weight of a X type metal-free phthalocyanine (CGM) as an electric charge generating material, 35 parts by weight of ETM-3 as an electron transferring material, any one of 10, 30, 55 or 75 parts by weight of the compounds represented by the general formulas [3] to [6] as a hole transferring material (referred to as HTM-1, HTM-2, HTM-3 and HTM-4, respectively), 100 parts by weight of a copolymerized carbonate resin (Resin-1, molar ratio of copolymerization of a:b=20.0 :80.0, weight-average molecular weight: 100,000) which comprises a repeating unit represented by the general formula [2] and bisphenol Z, and 3 parts by weight of a polyalkylene glycol compound (one selected from PEG-1, PEG-2, PEG-3, PEG-4 and PEG-5)represented by the general formula [1] were mixed and dispersed together with 800 parts by weight of tetrahydrofuran in a ball mill for 24 hours to prepare a coating solution for single-layer type photosensitive layer. Then, this coating solution was coated on an aluminum tube as the conductive substrate by using the dip coating method, followed by hot-air drying at 125° C. for 45 minutes to produce a single-layer type photosensitive material having a single photosensitive layer of 30 $\mu$m in film thickness, respectively.

Examples 24 and 25

In the same manner as in Example 3, except for using HTM-5 or HTM-6 as the hole transferring material, single-layer type photosensitive materials were produced, respectively.

Examples 26 to 29

In the same manner as in Example 1 to 4, except for using a bisphenol Z type polycarbonate resin of weight-average molecular weigh 100,000 (Resin-2) as the binder resin, single-layer type photosensitive materials were produced, respectively.

Comparative Examples 1 to 4

In the same manner as in Example 3 and 5 to 7, except for using no polyalkylene glycol compounds, single-layer type photosensitive materials were produced, respectively.

Comparative Examples 5 and 6

In the same manner as in Example 3, except for using PEG-6 (Trade name: IONET MS-300, produced by Sanyo Chemicals, Co. Ltd.) or PEG-7 (produced by Aldrich Co.) of polyalkylene glycol compounds whose terminal hydroxyl group (—OH group) is not esterified or etherified, single-layer type photosensitive materials were produced, respectively.

Comparative Examples 7 and 8

In the same manner as in Example 3, except for using MCA-001 (fine particles of melamineisocyanate, produced by Mitsubishi Chemicals, Co. Ltd.) or LUBRON 12(fine particles of fluorine resin, produced by Dikin, Co. Ltd.) as an additive for improving wear resistance, which are not polyalkylene glycol compounds, single-layer type photosensitive materials were produced, respectively.

The evaluation results of single-layer type photosensitive materials prepared by the above Examples and Comparative Examples are shown in Tables 1 to 4.

TABLE 1

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Ex. 1 | Resin-1 | PEG-1 | HTM-1 | 10 | ETM-3 | 35 | 29.7 | 1.6 | 118 | 54 |
| Ex. 2 | Resin-1 | PEG-1 | HTM-1 | 30 | ETM-3 | 35 | 37.9 | 2 | 105 | 48 |
| Ex. 3 | Resin-1 | PEG-1 | HTM-1 | 55 | ETM-3 | 35 | 45.8 | 2.3 | 82 | 40 |
| Ex. 4 | Resin-1 | PEG-1 | HTM-1 | 75 | ETM-3 | 35 | 50.8 | 2.8 | 78 | 38 |
| Ex. 5 | Resin-1 | PEG-1 | HTM-2 | 55 | ETM-3 | 35 | 45.8 | 2.4 | 105 | 45 |
| Ex. 6 | Resin-1 | PEG-1 | HTM-3 | 55 | ETM-3 | 35 | 45.8 | 2.5 | 102 | 42 |
| Ex. 7 | Resin-1 | PEG-1 | HTM-4 | 55 | ETM-3 | 35 | 45.8 | 2.4 | 105 | 44 |
| Ex. 8 | Resin-1 | PEG-2 | HTM-1 | 55 | ETM-3 | 35 | 45.8 | 2.2 | 85 | 45 |
| Ex. 9 | Resin-1 | PEG-2 | HTM-2 | 55 | ETM-3 | 35 | 45.8 | 2.5 | 110 | 48 |
| Ex. 10 | Resin-1 | PEG-2 | HTM-3 | 55 | ETM-3 | 35 | 45.8 | 2.5 | 106 | 44 |
| Ex. 11 | Resin-1 | PEG-2 | HTM-4 | 55 | ETM-3 | 35 | 45.8 | 2.4 | 109 | 45 |
| Ex. 12 | Resin-1 | PEG-3 | HTM-1 | 55 | ETM-3 | 35 | 45.8 | 2.5 | 84 | 39 |
| Ex. 13 | Resin-1 | PEG-3 | HTM-2 | 55 | ETM-3 | 35 | 45.8 | 2.7 | 112 | 46 |
| Ex. 14 | Resin-1 | PEG-3 | HTM-3 | 55 | ETM-3 | 35 | 45.8 | 2.6 | 108 | 40 |
| Ex. 15 | Resin-1 | PEG-3 | HTM-4 | 55 | ETM-3 | 35 | 45.8 | 2.7 | 108 | 41 |
| Ex. 16 | Resin-1 | PEG-4 | HTM-1 | 55 | ETM-3 | 35 | 45.8 | 2 | 86 | 43 |
| Ex. 17 | Resin-1 | PEG-4 | HTM-2 | 55 | ETM-3 | 35 | 45.8 | 2.2 | 114 | 47 |
| Ex. 18 | Resin-1 | PEG-4 | HTM-3 | 55 | ETM-3 | 35 | 45.8 | 2.2 | 110 | 45 |
| Ex. 19 | Resin-1 | PEG-4 | HTM-4 | 55 | ETM-3 | 35 | 45.8 | 2.1 | 111 | 47 |
| Ex. 20 | Resin-1 | PEG-5 | HTM-1 | 55 | ETM-3 | 35 | 45.8 | 2.3 | 88 | 47 |
| Ex. 21 | Resin-1 | PEG-5 | HTM-2 | 55 | ETM-3 | 35 | 45.8 | 2.5 | 119 | 54 |
| Ex. 22 | Resin-1 | PEG-5 | HTM-3 | 55 | ETM-3 | 35 | 45.8 | 2.5 | 115 | 50 |
| Ex. 23 | Resin-1 | PEG-5 | HTM-4 | 55 | ETM-3 | 35 | 45.8 | 2.5 | 114 | 52 |

TABLE 2

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Ex. 24 | Resin-1 | PEG-1 | HTM-5 | 55 | ETM-1 | 35 | 45.8 | 2.5 | 114 | 48 |
| Ex. 25 | Resin-1 | PEG-1 | HTM-6 | 55 | ETM-1 | 35 | 45.8 | 2.6 | 117 | 47 |

TABLE 3

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Ex. 26 | Resin-2 | PEG-1 | HTM-1 | 10 | ETM-1 | 35 | 29.7 | 2.3 | 120 | 57 |
| Ex. 27 | Resin-2 | PEG-1 | HTM-1 | 30 | ETM-1 | 35 | 37.9 | 2.6 | 105 | 50 |
| Ex. 28 | Resin-2 | PEG-1 | HTM-1 | 55 | ETM-1 | 35 | 45.8 | 2.7 | 85 | 45 |
| Ex. 29 | Resin-2 | PEG-1 | HTM-1 | 75 | ETM-1 | 35 | 50.8 | 2.8 | 80 | 40 |

TABLE 4

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Co. Ex. 1 | Resin-1 | No added | HTM-1 | 55 | ETM-1 | 35 | 45.8 | 3.4 | 82 | 85 |
| Co. Ex. 2 | Resin-1 | No added | HTM-2 | 55 | ETM-1 | 35 | 45.8 | 3.5 | 106 | 90 |
| Co. Ex. 3 | Resin-1 | No added | HTM-3 | 55 | ETM-1 | 35 | 45.8 | 3.7 | 104 | 86 |
| Co. Ex. 4 | Resin-1 | No added | HTM-4 | 55 | ETM-1 | 35 | 45.8 | 3.2 | 107 | 88 |
| Co. Ex. 5 | Resin-1 | PEG-6 | HTM-1 | 55 | ETM-1 | 35 | 45.8 | 2.4 | 123 | 55 |
| Co. Ex. 6 | Resin-1 | PEG-7 | HTM-1 | 55 | ETM-1 | 35 | 45.8 | 2.5 | 141 | 54 |
| Co. Ex. 7 | Resin-1 | MCA-001 | HTM-1 | 55 | ETM-1 | 35 | 45.8 | 2.5 | 110 | 97 |
| Co. Ex. 8 | Resin-1 | Rublon L2 | HTM-1 | 55 | ETM-1 | 35 | 45.8 | 2.5 | 118 | 94 |

From the results of Tables 1 to 3, it is apparent that when the polyalkylene glycol compounds represented by the general formula [1] are incorporated in the binder resin, the resulting single-layer type electrophotosensitive materials are superior in wear resistance, sensitivity and ozone resistance.

More particularly, the results of Table 1 show that HTM-1, HTM-2, HTM-3 and HTM-4 as the hole transferring material can be preferably used together with PEG-1, PEG-2, PEG-3, PEG-4 and PEG-5 as the polyalkylene compound represented by the general formula [1] in the present invention. Table 2 shows that HTM-5 and HTM-6 also are effective for producing the single-layer type electrophotosensitive material of the present invention as the hole transferring material. Resin-2 also can be preferably used as the binder resin as shown in Table 3.

On the other hand, Comparative Examples 1 to 4 (Table 4) show that the wear amounts are over 3 $\mu$m and $\Delta v_0$ are 60V or more since no additive for improving the wear resistance are added. Accordingly, the wear resistance and the ozone resistance were inferior.

Comparative Examples 5 and 6 (Table 4) show that the respective sensitivities are inferior as is clear from the results that the residual potentials become over 120V. This reason is based on that the polyalkylene glycol compounds (PEG-6 and PEG-7) which are not subjected to esterification or etherification at the terminal hydroxyl group are used in these Comparative Examples.

Comparative Examples 7 and 8 (Table 4) show that the ozone resistance is inferior since $\Delta V_0$ is over 60V. This reason is based on that the additives (MCA-001 or LUBRON L2) for improving the wear resistance other than the polyalkylene glycol compound are used in these Comparative Examples.

Moreover, Table 5 shows the relationships of (1) the wear amount, (2) the residual potential (sensitivity) and (3) $\Delta V_0$ (ozone resistance) to the solid content of the electric charge transferring materials relative to the entire solid content (ECTM) on the basis of evaluation data of Examples 1 to 4 and 26 to 29.

TABLE 5

| | ECTM (wt %) | Wear amount ($\mu$m) | Residual potential (V) | Ozone resistance (V) |
|---|---|---|---|---|
| Ex. 1 | 29.7 | 1.6 | 118 | 54 |
| Ex. 2 | 37.9 | 2 | 105 | 48 |
| Ex. 3 | 45.8 | 2.3 | 82 | 40 |
| Ex. 4 | 50.8 | 2.8 | 78 | 38 |
| Ex. 26 | 29.7 | 2.3 | 120 | 57 |
| Ex. 27 | 37.9 | 2.6 | 105 | 50 |
| Ex. 28 | 45.8 | 2.7 | 85 | 45 |
| Ex. 29 | 50.8 | 2.8 | 80 | 40 |

Figure 2:
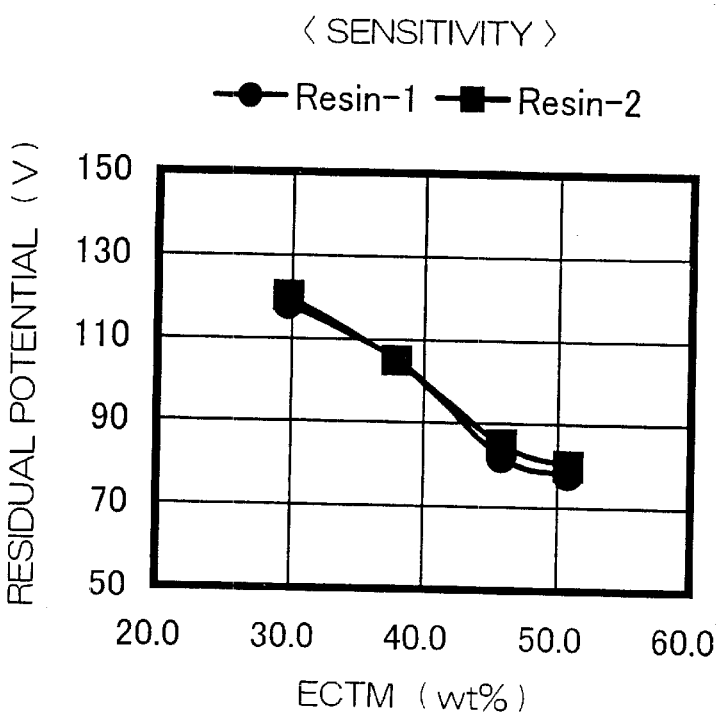
FIG. 2 is a graph showing the relationship between the solid content of an electric charge transferring materials relative to the entire solid content (ECTM) and the residual potential (sensitivity) on the basis of evaluation date of Examples 1 to 4 and 26 to 29.
Figure 3:
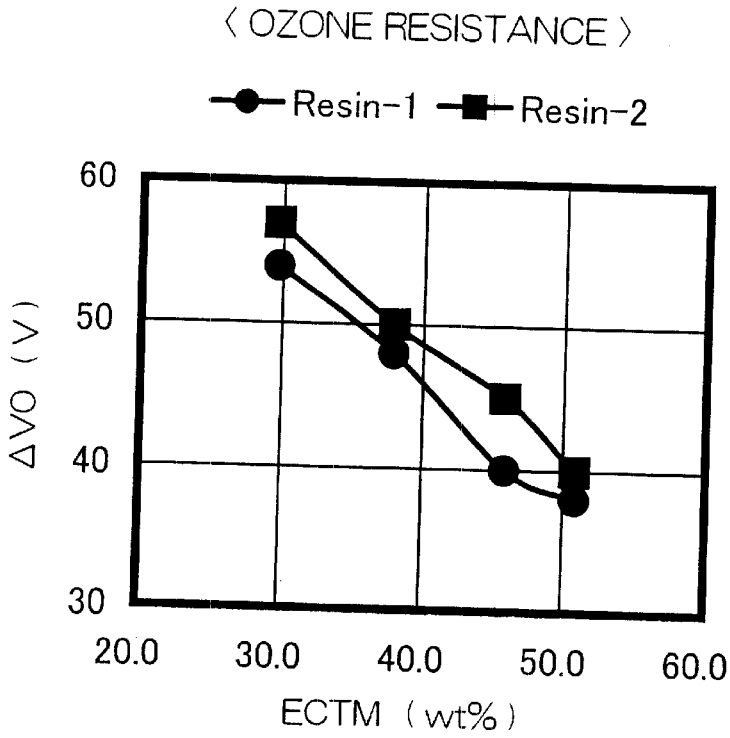
FIG. 3 is a graph showing the relationship between the solid content of an electric charge transferring materials relative to the entire solid content (ECTM) and $\Delta V_0$ (ozone resistance) on the basis of evaluation date of Examples 1 to 4 and 26 to 29.

In addition, FIGS. 1 to 3 are graphs showing the relationships of the above (1), (2) and (3) to the solid content of the electric charge transferring materials relative to the entire solid content on the basis of data of Table 5, respectively.

As shown in FIGS. 1 to 3, when the solid content of the electric charge transferring materials relative to the entire solid content is about 30% by weight to about 50% by weight, the resulting single-layer type photosensitive materials are superior in wear amount, residual potential and ozone resistance.

Examples 30 to 57

2.5 parts by weight of a X type metal-free phthalocyanine (CGM) as an electric charge generating material, 60 parts by weight of HTM-7 as a hole transferring material, any one of 5, 20, 30 or 50 parts by weight of the compounds (one selected from ETM-1, ETM-2, ETM-3, ETM-4 and ETM-5) represented by the general formulas [7] to [10] as an electron transferring material, 100 parts by weight of a copolymerized carbonate resin (Resin-2, molar ratio of copolymerization of a:b=25.0:75.0) which comprises a repeating unit represented by the general formula [2] and bisphenol Z, and 3.5 parts by weight of a polyalkylene glycol compound (one selected from PEG-1, PEG-2, PEG-3, PEG-4 and PEG-g) represented by the general formula [1] were mixed and dispersed together with 750 parts by weight of tetrahydrofuran in a ball mill for 20 hours to prepare a coating solution for single-layer type photosensitive layer. Then, this coating solution was coated on an aluminum tube as the conductive substrate by using the dip coating method, followed by hot-air drying at 130° C. for 35 minutes to produce a single-layer type photosensitive material having a single photosensitive layer of 26 $\mu$m in film thickness, respectively.

Examples 58 and 59

In the same manner as in Example 32, 34 to 37, except for using ETM-6 or ETM-7 as the electron transferring material, single-layer type photosensitive materials were produced, respectively.

Examples 60 to 63

In the same manner as in Example 30 to 33, except for using a bisphenol Z type polycarbonate resin of weight-average molecular weigh 80,000 (Resin-2) as the binder resin, single-layer type photosensitive materials were produced, respectively.

Comparative Examples 9 to 13

In the same manner as in Example 32, 34 to 37, except for using no polyalkylene glycol compounds, single-layer type photosensitive materials were produced, respectively.

Comparative Examples 14 and 15

In the same manner as in Example 32, except for using PEG-6 or PEG-7 of a polyalkylene glycol compound whose terminal hydroxyl group (—OH group) is not esterified or etherified, single-layer type photosensitive materials were produced, respectively.

Comparative Examples 16 and 17

In the same manner as in Example 32, except for using MCA-001 (fine particles of melamine isocyanate, produced by Mitsubishi Chemicals, Co. Ltd.) or LUBRON 12 (fine particles of fluorine resin, produced by Dikin, Co. Ltd.) as an additive for improving wear resistance, which are not polyalkylene glycol compounds, single-layer type photosensitive materials were produced, respectively.

The evaluation results of single-layer type photosensitive materials prepared by the above Examples 30 to 63 and Comparative Examples 9 to 17 are shown in Tables 6 to 9.

TABLE 6

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Ex. 30 | Resin-1 | PEG-1 | ETM-1 | 5 | HTM-7 | 60 | 38.0 | 1.4 | 120 | 52 |
| Ex. 31 | Resin-1 | PEG-1 | ETM-1 | 20 | HTM-7 | 60 | 43.0 | 1.8 | 109 | 45 |
| Ex. 32 | Resin-1 | PEG-1 | ETM-1 | 30 | HTM-7 | 60 | 45.9 | 2.4 | 85 | 38 |
| Ex. 33 | Resin-1 | PEG-1 | ETM-1 | 50 | HTM-7 | 60 | 50.9 | 2.9 | 80 | 35 |
| Ex. 34 | Resin-1 | PEG-1 | ETM-2 | 30 | HTM-7 | 60 | 45.9 | 2.5 | 85 | 43 |
| Ex. 35 | Resin-1 | PEG-1 | ETM-3 | 30 | HTM-7 | 60 | 45.9 | 2.6 | 88 | 48 |
| Ex. 36 | Resin-1 | PEG-1 | ETM-4 | 30 | HTM-7 | 60 | 45.9 | 2.4 | 95 | 45 |
| Ex. 37 | Resin-1 | PEG-1 | ETM-5 | 30 | HTM-7 | 60 | 45.9 | 2.7 | 105 | 36 |
| Ex. 38 | Resin-1 | PEG-2 | ETM-1 | 30 | HTM-7 | 60 | 45.9 | 2.3 | 86 | 43 |
| Ex. 39 | Resin-1 | PEG-2 | ETM-2 | 30 | HTM-7 | 60 | 45.9 | 2.4 | 87 | 48 |
| Ex. 40 | Resin-1 | PEG-2 | ETM-3 | 30 | HTM-7 | 60 | 45.9 | 2.5 | 90 | 52 |
| Ex. 41 | Resin-1 | PEG-2 | ETM-4 | 30 | HTM-7 | 60 | 45.9 | 2.5 | 96 | 49 |
| Ex. 42 | Resin-1 | PEG-2 | ETM-5 | 30 | HTM-7 | 60 | 45.9 | 2.5 | 108 | 42 |
| Ex. 43 | Resin-1 | PEG-3 | ETM-1 | 30 | HTM-7 | 60 | 45.9 | 2.6 | 86 | 40 |
| Ex. 44 | Resin-1 | PEG-3 | ETM-2 | 30 | HTM-7 | 60 | 45.9 | 2.5 | 86 | 45 |
| Ex. 45 | Resin-1 | PEG-3 | ETM-3 | 30 | HTM-7 | 60 | 45.9 | 2.8 | 91 | 50 |
| Ex. 46 | Resin-1 | PEG-3 | ETM-4 | 30 | HTM-7 | 60 | 45.9 | 2.7 | 97 | 48 |
| Ex. 47 | Resin-1 | PEG-3 | ETM-5 | 30 | HTM-7 | 60 | 45.9 | 2.7 | 110 | 39 |
| Ex. 48 | Resin-1 | PEG-4 | ETM-1 | 30 | HTM-7 | 60 | 45.9 | 1.9 | 85 | 45 |
| Ex. 49 | Resin-1 | PEG-4 | ETM-2 | 30 | HTM-7 | 60 | 45.9 | 1.9 | 86 | 50 |
| Ex. 50 | Resin-1 | PEG-4 | ETM-3 | 30 | HTM-7 | 60 | 45.9 | 2.1 | 90 | 54 |
| Ex. 51 | Resin-1 | PEG-4 | ETM-4 | 30 | HTM-7 | 60 | 45.9 | 2.3 | 96 | 51 |
| Ex. 52 | Resin-1 | PEG-4 | ETM-5 | 30 | HTM-7 | 60 | 45.9 | 2.2 | 106 | 44 |
| Ex. 53 | Resin-1 | PEG-5 | ETM-1 | 30 | HTM-7 | 60 | 45.9 | 2.5 | 87 | 49 |
| Ex. 54 | Resin-1 | PEG-5 | ETM-2 | 30 | HTM-7 | 60 | 45.9 | 2.4 | 88 | 53 |
| Ex. 55 | Resin-1 | PEG-5 | ETM-3 | 30 | HTM-7 | 60 | 45.9 | 2.6 | 90 | 57 |
| Ex. 56 | Resin-1 | PEG-5 | ETM-4 | 30 | HTM-7 | 60 | 45.9 | 2.5 | 96 | 54 |
| Ex. 57 | Resin-1 | PEG-5 | ETM-5 | 30 | HTM-7 | 60 | 45.9 | 2.6 | 109 | 48 |

TABLE 7

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Ex. 58 | Resin-1 | PEG-1 | ETM-6 | 30 | HTM-7 | 60 | 45.9 | 2.6 | 118 | 48 |
| Ex. 59 | Resin-1 | PEG-1 | ETM-7 | 30 | HTM-7 | 60 | 45.9 | 2.7 | 117 | 52 |

TABLE 8

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Ex. 60 | Resin-2 | PEG-1 | ETM-1 | 5 | HTM-7 | 60 | 38.0 | 1.9 | 119 | 55 |
| Ex. 61 | Resin-2 | PEG-1 | ETM-1 | 20 | HTM-7 | 60 | 43.0 | 2.4 | 112 | 47 |
| Ex. 62 | Resin-2 | PEG-1 | ETM-1 | 30 | HTM-7 | 60 | 45.9 | 2.7 | 87 | 41 |
| Ex. 63 | Resin-2 | PEG-1 | ETM-1 | 50 | HTM-7 | 60 | 50.9 | 2.8 | 83 | 36 |

TABLE 9

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Co. Ex. 9 | Resin-1 | No added | ETM-1 | 30 | HTM-7 | 60 | 45.9 | 3.5 | 86 | 83 |
| Co. Ex. 10 | Resin-1 | No added | ETM-2 | 30 | HTM-7 | 60 | 45.9 | 3.7 | 88 | 88 |
| Co. Ex. 11 | Resin-1 | No added | ETM-3 | 30 | HTM-7 | 60 | 45.9 | 3.6 | 92 | 97 |
| Co. Ex. 12 | Resin-1 | No added | ETM-4 | 30 | HTM-7 | 60 | 45.9 | 3.4 | 98 | 86 |
| Co. Ex. 13 | Resin-1 | No added | ETM-5 | 30 | HTM-7 | 60 | 45.9 | 3.4 | 105 | 80 |
| Co. Ex. 14 | Resin-1 | PEG-6 | ETM-1 | 30 | HTM-7 | 60 | 45.9 | 2.5 | 123 | 53 |

TABLE 9-continued

| | Binder reesin | PAGC | HTM Kind | HTM Amount (parts) | ETM Kind | ETM Amount (parts) | ECTM (wt %) | Wear amount (μm) | Residual potential (V) | Ozone resistance (V) |
|---|---|---|---|---|---|---|---|---|---|---|
| Co. Ex. 15 | Resin-1 | PEG-7 | ETM-1 | 30 | HTM-7 | 60 | 45.9 | 2.6 | 138 | 52 |
| Co. Ex. 16 | Resin-1 | MCA-001 | ETM-1 | 30 | HTM-7 | 60 | 45.9 | 2.6 | 106 | 85 |
| Co. Ex. 17 | Resin-1 | Rublon L2 | ETM-1 | 30 | HTM-7 | 60 | 45.9 | 2.6 | 115 | 86 |

From the results of Tables 6 to 8, it is apparent that, it is apparent that when the polyalkylene glycol compounds represented by the general formula [1] are incorporated in the binder resin, the resulting single-layer type electrophotosensitive materials are superior in wear resistance, sensitivity and ozone resistance.

More particularly, the results of Table 6 show that ETM-1, ETM-2, ETM-3 and ETM-4 as the electron transferring material can be preferably used together with PEG-1, PEG-2, PEG-3, PEG-4 and PEG-5 as the polyalkylene compound represented by the general formula [1] in the present invention. Table 7 shows that ETM-6 and ETM-7 also are effective for producing the single-layer type electrophotosensitive material of the present invention as the electron transferring material. Resin-2 also can be preferably used as the binder resin as shown in Table 8.

On the other hand, Comparative Examples 9 to 13(Table 9) show that the wear amounts are over 3 μm and $\Delta V_0$ are 60V or more since no additive for improving the wear resistance are added. Accordingly, the wear resistance and the ozone resistance were inferior.

Comparative Examples 14 and 15 (Table 9) show that the respective sensitivities are inferior as is clear from the results that the residual potentials become over 120V. This reason is based on that the polyalkylene glycol compounds (PEG-6and PEG-7) whose terminal hydroxyl group is not esterified or etherified are used in these Comparative Examples.

Comparative Examples 16 and 17 (Table 9) show that the ozone resistance is inferior since $\Delta V_0$ is over 60V. This reason is based on that the additives (MCA-001 or LUBRON L2) for improving the wear resistance other than the polyalkylene glycol compound are used in these Comparative Examples.

Moreover, Table 10 show the relationships of (1) the wear amount, (2) there sidual potential (sensitivity) and (3) $\Delta V_0$ (ozone resistance) to the solid content of the electric charge transferring materials relative to the entire solid content (ECTM) on the basis of the evaluation data of Examples 30 to 33 and 60 to 63.

TABLE 10

| | ECTM (wt %) | Wear amount (μm) | Residual potential (V) | Ozone resistance (V) |
|---|---|---|---|---|
| Ex. 30 | 38 | 1.4 | 120 | 52 |
| Ex. 31 | 43 | 1.8 | 109 | 45 |
| Ex. 32 | 45.9 | 2.4 | 85 | 38 |
| Ex. 33 | 50.9 | 2.9 | 80 | 35 |
| Ex. 60 | 38 | 1.9 | 119 | 55 |
| Ex. 61 | 43 | 2.4 | 112 | 47 |
| Ex. 62 | 45.9 | 2.7 | 87 | 41 |
| Ex. 63 | 50.9 | 2.8 | 83 | 36 |

Figure 4:
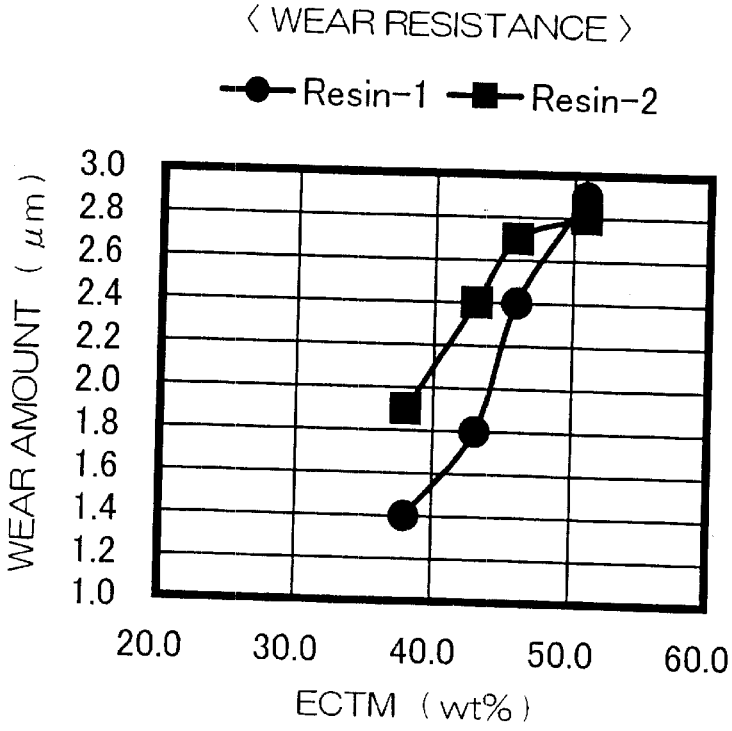
FIG. 4 is a graph showing the relationship between the solid content of an electric charge transferring materials relative to the entire solid content (ECTM) and the wear amount on the basis of evaluation date of Examples 30 to 33 and 60 to 63.
Figure 5:
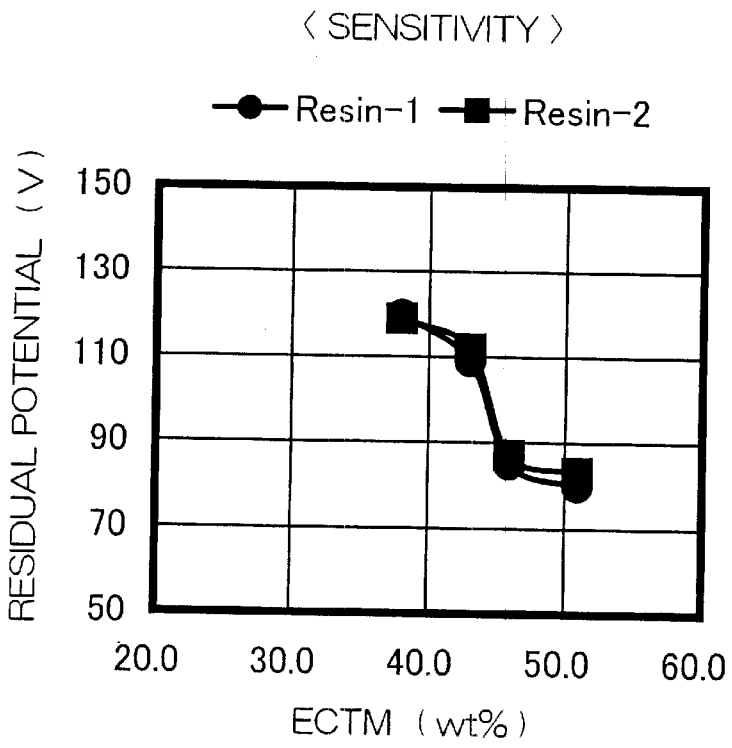
FIG. 5 is a graph showing the relationship between the solid content of an electric charge transferring materials relative to the entire solid content (ECTM) and the residual potential (sensitivity) on the basis of evaluation date of Examples 30 to 33 and 60 to 63.
Figure 6:
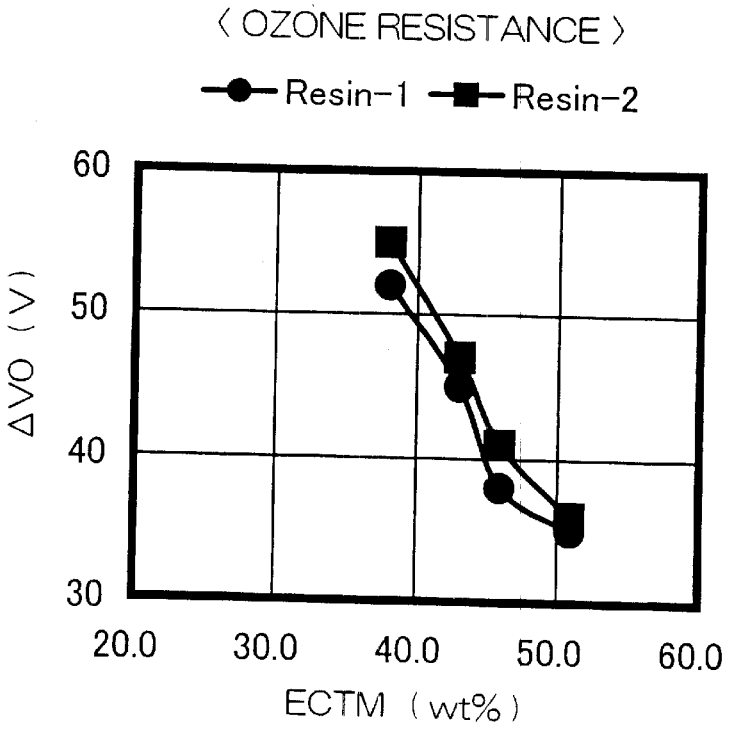
FIG. 6 is a graph showing the relationship between the solid content of an electric charge transferring materials relative to the entire solid content (ECTM) and $Av_0$ (ozone resistance) on the basis of evaluation date of Examples 30 to 33 and 60 to 63.

In addition, FIGS. 4 to 6 are graphs showing the relationships of the above (1), (2) and (3) to the solid content of the electric charge transferring materials relative to the entire solid content on the basis of data of Table 5, respectively.

As shown in FIGS. 4 to 6, when the solid content of the electric charge transferring materials relative to the entire solid content is about 30% by weight to about 50% by weight, the resulting single-layer type photosensitive materials are superior in wear amount, residual potential and ozone resistance.

A list of chemical formulas:

<HTM-1>

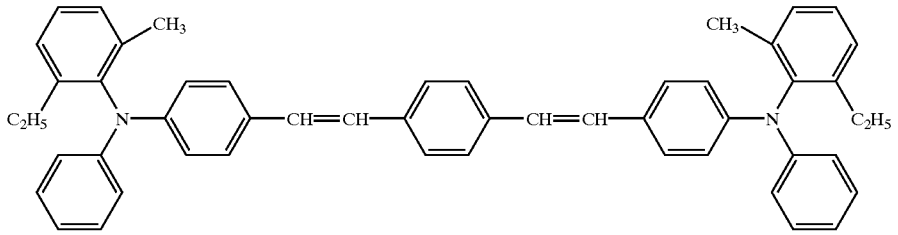

-continued
<HTM-2>
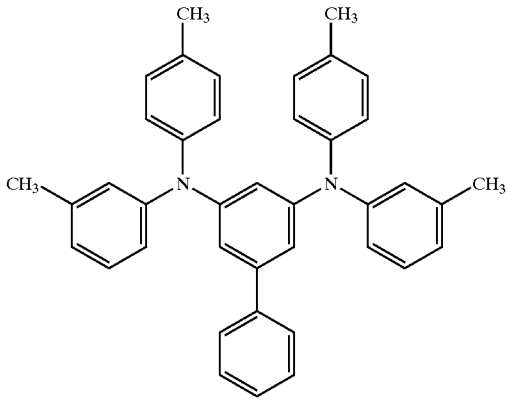
<HTM-3>
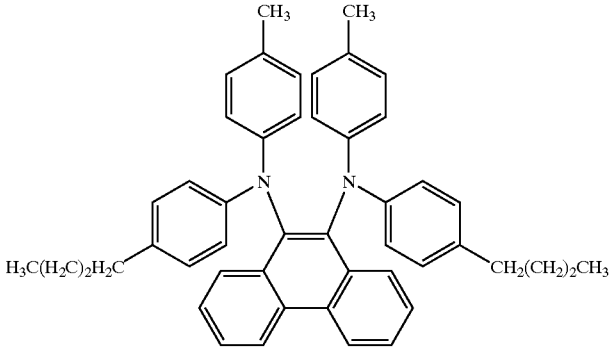
<HTM-4>
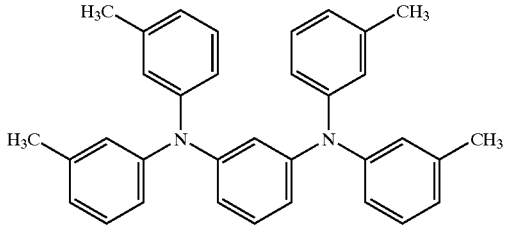
<HTM-5>
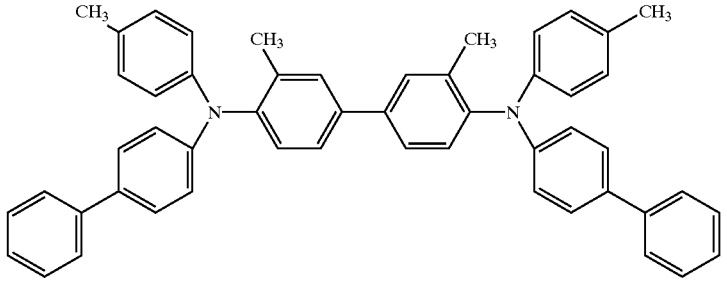
<HTM-6>
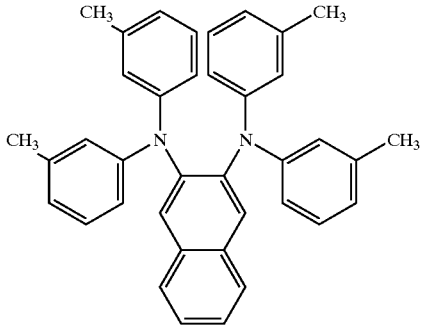

-continued
<HTM-7>
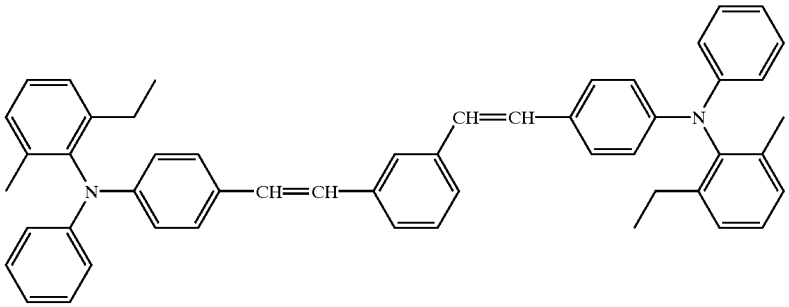
<ETM-1>
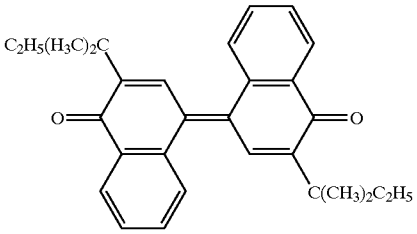
<ETM-2>
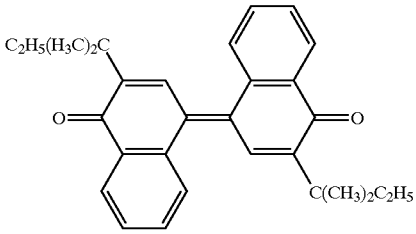
<ETM-3>
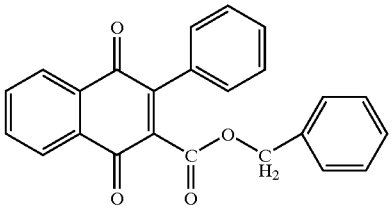
<ETM-4>
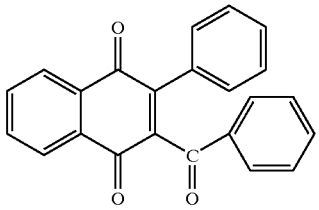
<ETM-5>
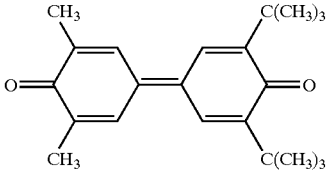
<ETM-6>
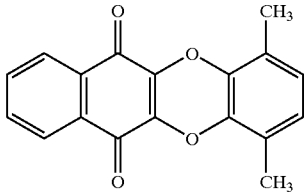
<ETM-7>
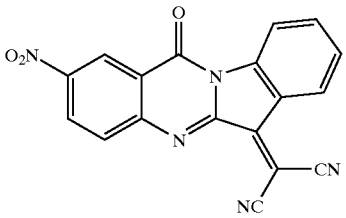
<Resin-1>
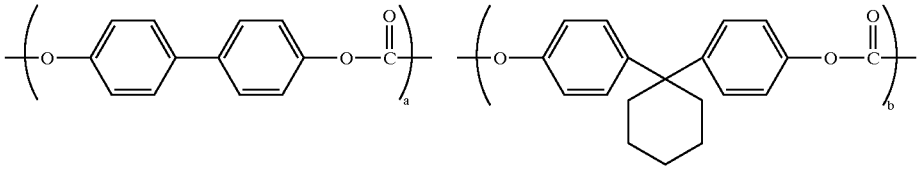
<Resin-2>
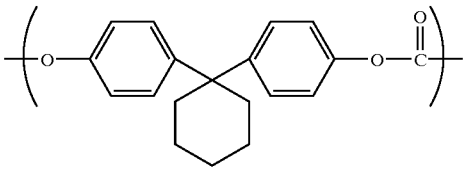

<PEG-1> (number-average molecular weight:560) Polyethylene glycol dilaurate $$C_{11}H_{23}—COO—(CH_2—CH_2—O)_n—CO—C_{11}H_{23}$$

<PEG-2> (number-average molecular weight:830) Polyethylene glycol distearate $$C_{17}H_{35}—COO—(CH_2—CH_2—O)_n—CO—C_{17}H_{35}$$

<PEG-3> (number-average molecular weight:500) Polyethylene glycol dimethyl ether $$CH_3—O—(CH_2—CH_2—O)_n—CH_3$$

<PEG-4> (number-average molecular weight:1000) Polyethylene glycol polypropylene glycol block copolymer diethyl ether $$C_2H_5—O—(CH_2—CH_2—O)_l—(CH_2CH_2CH_2—O)_m—(CH_2—CH_2—O)_n—C_2H_5$$

<PEG-5> (number-average molecular weight:800) Polyethylene glycol diphenyl ether

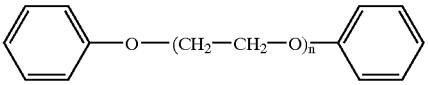

<PEG-6> (number-average molecular weight:570)

$$HO—(CH_2—CH_2—O)_n—CO—C_{17}H_{35}$$

<PEG-7> (number-average molecular weight:200)

$$HO—(CH_2—CH_2—O)_n—H$$

The disclosure of Japanese Patent Application Nos.2000-346709 and 2000-364683, filed on Nov. 14, 2000 and Nov. 30, 2000, respectively, is incorporated herein by reference.

What is claimed is:

1. A single-layer type electrophotosensitive material which comprises a conductive substrate, and a photosensitive layer made of a binder resin containing at least an electric charge generating material and an electric charge transferring material formed on said conductive substrate, wherein said photosensitive layer contains a polyalkylene glycol compound represented by the general formula [1]:

$$A_1—O—[(CH_2)_m—O]_n—A_2$$

wherein $A_1$ and $A_2$ are the same or different and represent an alkyl or aryl group having 1 to 50 carbon atoms, or a group: —CO—$R^{10}$ ($R^{10}$ represents an alkyl or aryl group having 1 to 50 carbon atoms), m represents an integer of 1 to 5, and n represents an integer of 2 to 100.

2. The single-layer type electrophotosensitive material according to claim 1, wherein the content of said polyalkylene glycol compound is not less than 50% by weight and not more than 500% by weight based on the content of the electric charge generating material.

3. The single-layer type electrophotosensitive material according to claim 1, wherein said binder resin is a polycarbonate resin represented by the general formula [2]:

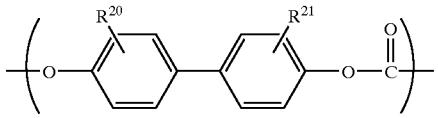

wherein $R^{20}$ and $R^{21}$ are the same or different and represent a hydrogen atom or an alkyl group having 1 to 3 carbon atoms.

4. The single-layer type electrophotosensitive material according to claim 1, wherein the principal component of said binder resin is a copolymerized polycarbonate resin of a repeating unit represented by the general formula [2] and bisphenol Z.

5. The single-layer type electrophotosensitive material according to claim 1, wherein said electric charge generating material is a phthalocyanine.

6. The single-layer type electrophotosensitive material according to claim 1, wherein said electric charge transferring materials are a hole transferring material and a electron transferring material.

7. The single-layer type electrophotosensitive material according to claim 1, wherein said electric transferring material is one or more of hole transferring material selected from the group consisting of:

a compound represented by the general formula [3]:

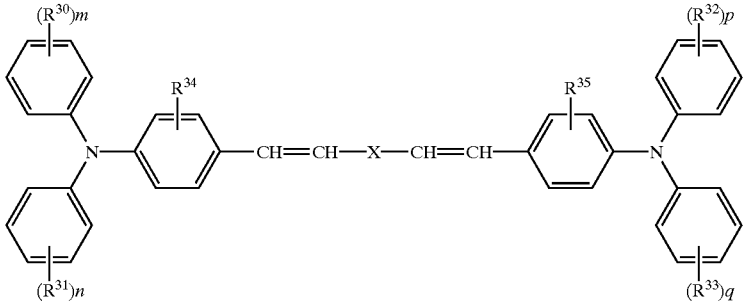

wherein $R^{30}$, $R^{31}$, $R^{32}$ and $R^{33}$ are the same or different and represent an alkyl group, an alkoxy group, an aryl group, an aralkyl group, or a halogen atom, m, n, p and q are the same or different and represent an integer of 0 to 3, $R^{34}$ and $R^{35}$ are the same or different and represent a hydrogen atom or an alkyl group, and —X— represents

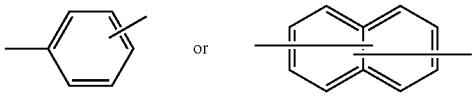

a compound represented by the general formula [4]:

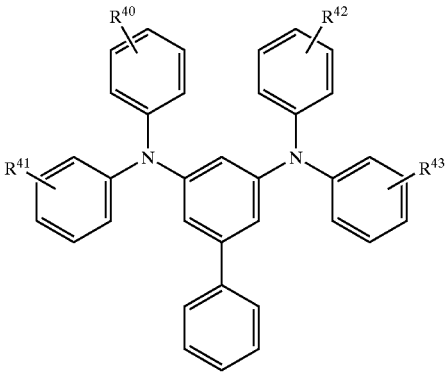

wherein $R^{40}$ and $R^{42}$ are the same or different and represent an alkyl group which may have a substituent, and $R^{41}$ and $R^{43}$ are the same or different and represent a hydrogen atom or an alkyl group which may have a substituent, a compound represented by the general formula [5]:

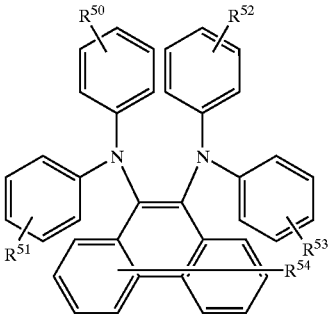

wherein $R^{50}$, $R^{51}$, $R^{52}$, $R^{53}$and $R^{54}$ are the same or different and represent a hydrogen atom, a halogen atom, or an alkyl or alkoxy group which may have a substituent, and, a compound represented by the general formula [6]:

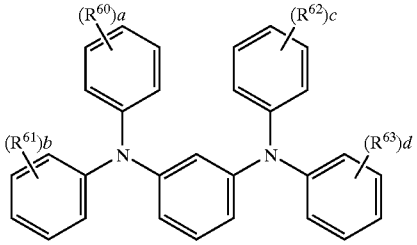

wherein $R^{60}$, $R^{61}$, $R^{62}$ and $R^{63}$ are the same or different and represent a halogen atom, or an alkyl, alkoxy or aryl group which may have a substituent, and a, b, c and d are the same or different and represent an integer of 0 to 5, provided that $R^{60}$, $R^{61}$, $R^{62}$ and $R^{63}$ may be different when a, b, c or d is not less than 2.

8. The single-layer type electrophotosensitive material according to claim 1, wherein said electric charge transferring material is one or more of electron charge transferring material selected from the group consisting of:

a compound represented by the general formula [7]:

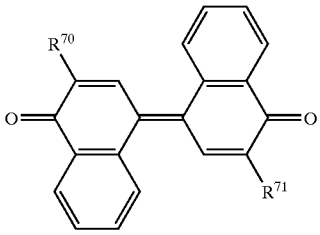

wherein $R^{70}$ and $R^{71}$ are the same or different and represent an alkyl group which may have a substituent, a compound represented by the general formula [8]:

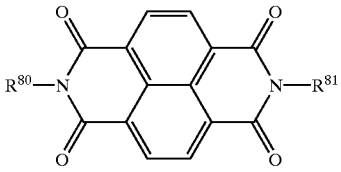

wherein $R^{80}$ and $R^{81}$ are the same or different and represent a monovalent hydrocarbon group which may have a substituent, a compound represented by the general formula [9]:

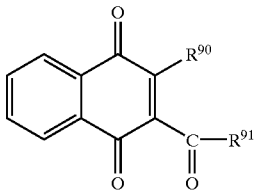

wherein $R^{90}$ represents a halogen atom, or an alkyl or aryl group which may have a substituent, and $R^{91}$ represents an alkyl or aryl group which may have a substituent, or a group: —O—$R^{91a}$ (in which $R^{91a}$ represents an alkyl or aryl group which may have a substituent), and, a compound represented by the general formula [10]:

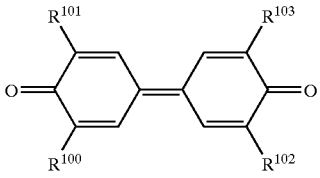

wherein $R^{100}$, $R^{101}$, $R^{102}$ and $R^{103}$ are the same or different and represent an alkyl group which may have a substituent.

9. The single-layer type electrophotosensitive material according to claim 1, wherein the solid content of said electric charge transferring material is not less than 30% by weight and not more than 55% by weight based on the entire solid content.

10. The single-layer type electrophotosensitive material according to claim 1, which is for image forming apparatuses having a mean for recovering the untransferred toner according to a blade cleaning.

* * * * *